US005926873A

United States Patent [19]

Fountain

[11] Patent Number: 5,926,873

[45] Date of Patent: Jul. 27, 1999

[54] CRIB RAILING GUARD

[76] Inventor: Irene Fountain, 828 S.E. 35th Ave., Ocala, Fla. 34471

[21] Appl. No.: 08/910,258

[22] Filed: Aug. 13, 1997

Related U.S. Application Data

[63] Continuation-in-part of application No. 08/517,085, Aug. 21, 1995.

[51] Int. Cl.[6] ..... A47D 7/00

[52] U.S. Cl. ..... 5/424; 5/93.1; 5/425; 5/945; 5/946

[58] Field of Search ..... 5/424, 945, 946, 5/663, 425, 426

[56] References Cited

U.S. PATENT DOCUMENTS

| | | | |
|---|---|---|---|
| 3,018,492 | 1/1962 | Rosen . | |
| 3,619,824 | 11/1971 | Doyle | 5/93 |
| 3,803,646 | 4/1974 | Newerowski . | |
| 5,010,611 | 4/1991 | Mallett . | |
| 5,410,765 | 5/1995 | Dicken | 5/93.1 |
| 5,421,046 | 6/1995 | Vande Streek | 5/624 |

*Primary Examiner*—Michael F. Trettel
*Assistant Examiner*—Fredrick Couley
*Attorney, Agent, or Firm*—Harness, Dickey & Pierce, PLC

[57] ABSTRACT

A railing guard is provided for alleviating previous deficiencies with crib protectants. The crib railing guard disclosed protects infants from injury and discomfort resulting from impact against and contact with side railing on baby cribs. Furthermore, the crib railing guard provides a self-supportive, comfortable enclosure for care of infants on surfaces with or without side railing. The crib railing guard is composed of a base, a cushiony wall and fasteners. The base is sized and shaped to correspond to an infant mattress. The base, when used in conjunction with an infant bed, is placed on top of the mattress support structure and beneath the mattress. The cushiony wall is connected to the perimeter of the base and projects upward. The lower portion of the cushiony wall is designed to compress when a mattress is placed on top of the base in order to fit the crib railing guard between the crib railing and the mattress. The fasteners are located around the outside of the cushiony wall to enable attachment to the crib railing in pre-selected order to maintain the cushiony wall in a position against the crib railing.

8 Claims, 4 Drawing Sheets

CRIB RAILING GUARD

CROSS REFERENCE TO RELATED APPLICATION

This application is a continuation-in-part of co-pending application Ser. No. 08/517,085 filed Aug. 21, 1995.

BACKGROUND OF THE INVENTION

1. Technical Field

The present invention generally relates to protection devices and, more particularly, to a crib guard for protecting infants from injury and discomfort from impact against and contact with the side railings typically found on baby cribs.

2. Discussion

Various protection devices have been devised over the years for preventing infants from being injured due to impact against and contact with the side railings of baby cribs. None, however, provide ease of use, reliability of positioning, comfort, adaptability to different use conditions, durability, low cost and ease of care and cleaning as provided by the present invention.

Examples of related art crib guards are described in the following patent documents. U.S. Pat. No. 5,010,611 issued to Mallett on Apr. 30, 1991, is directed toward a fitted fabric crib mattress bottom sheet having fabric sections extended vertically above and below the outside edges for attachment to baby crib rails and for positioning under the edges of a crib mattress. A cushion bumper is attachable to a vertical extension above the crib mattress. U.S. Pat. No. 4,788,726, issued to Rafalko on Dec. 6, 1988, is directed toward an infant support panel having a serpentine endless roll edge for confining an infant while being changed, sleeping or moving within the limits of the endless roll edge. The roll edge obviates the need for a crib wall.

Other examples of known crib guards are described in Canadian Patent Number 510,623, issued to McNish on Mar. 8, 1955; U.S. Pat. No. 5,410,765, issued to Dicken on May 2, 1995; U.S. Pat. No. 3,877,090, issued to Schutz on Apr. 15, 1975; and U.S. Pat. No. 2,128,978, issued to Akin on Sep. 6, 1938.

In light of product deficiencies in safety, comfort and convenience that have existed and that continue to exist in protecting infants in crib or crib-like positioning, objectives of this invention are to provide a crib railing guard which cushions the contact of infants with crib railings, prevents the entry of arms, legs or heads of infants between crib railing bars, and prevents entry of arms, legs or heads of infants between the crib railing guard and the mattress. Additionally, it is an object of the present invention to provide a railing guard which can be used in or out of a crib in conjunction with a crib mattress or other base padding to support an infant safely and comfortably. Further, it is an object of the present invention to provide a railing guard which is vertically self-supportive and may be secured to the crib rails to maintain vertical and horizontal orientation when used in a crib.

Yet another object of the present invention is to provide a railing guard which can be washed or cleaned in conjunction with or independently of other bed linens. Still yet another object of the present invention is to provide a railing guard which is inflatable. A further object of the present invention is to provide a railing guard which is made from disposable paper fabric and is structured with moisture-resistant materials.

SUMMARY OF THE INVENTION

The above and other objectives are provided by a crib railing guard having a vertically self-supportive cushion wall having a plurality of position maintaining fasteners therein. The cushion wall borders a base that is adapted to fit under a mattress. The mattress is preferably a baby mattress, but can also be an inflatable mattress or some other form of base padding. A mattress receiving portion of the cushion wall deforms to fit between the outside edges of the mattress and the inside edges of a crib railing. Optionally, the crib railing guard has a thickness that is greater above the mattress than that which is juxtaposed with the mattress for extra cushion comfort. Additionally, the crib railing guard may have a uniform thickness for additional vertical support for facilitating use without a crib or crib-like structure. Furthermore, the crib railing guard can be constructed with moisture-resistant material for infant care uses such as changing, feeding or containment of infants comfortably. Moreover, the cushion wall of the crib railing guard may be inflatable.

BRIEF DESCRIPTION OF DRAWINGS

In order to appreciate the manner in which the advantages and objects of the invention are obtained, a more particular description of the invention will be rendered by reference to specific embodiments thereof which are illustrated in the appended drawings. Understanding that these drawings only depict preferred embodiments of the present invention and are not therefore to be considered limiting in scope, the invention will be described and explained with additional specificity and detail through the use of the accompanying drawings in which.

DETAILED DESCRIPTION OF PREFERRED EMBODIMENTS

Figure 1:
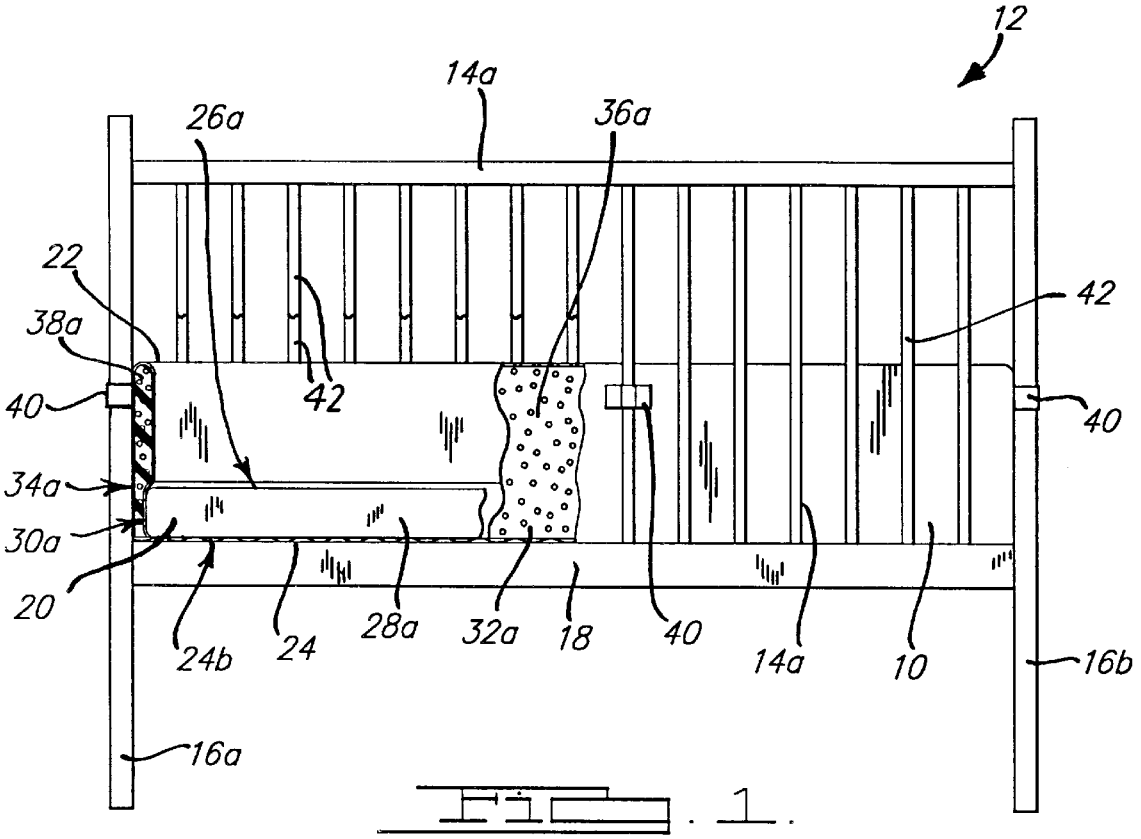
FIG. 1 is a partially cutaway side view of a rail guard used in conjunction with a crib according to the teachings of the present invention.
Figure 2:
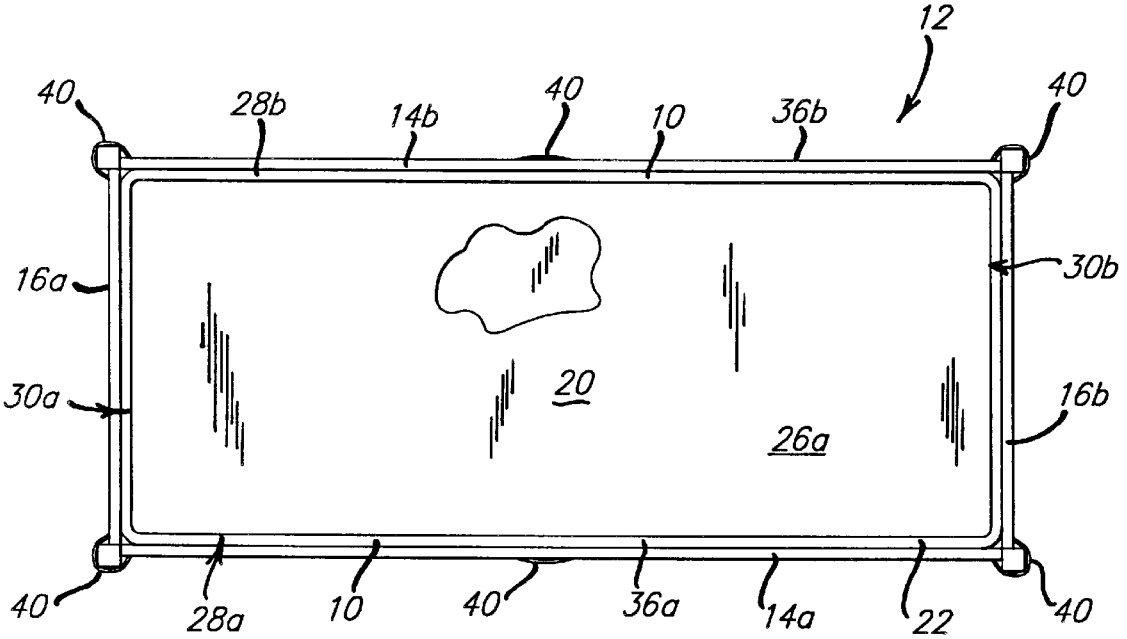
FIG. 2 is a top view of the rail guard of FIG. 1.
Figure 3:
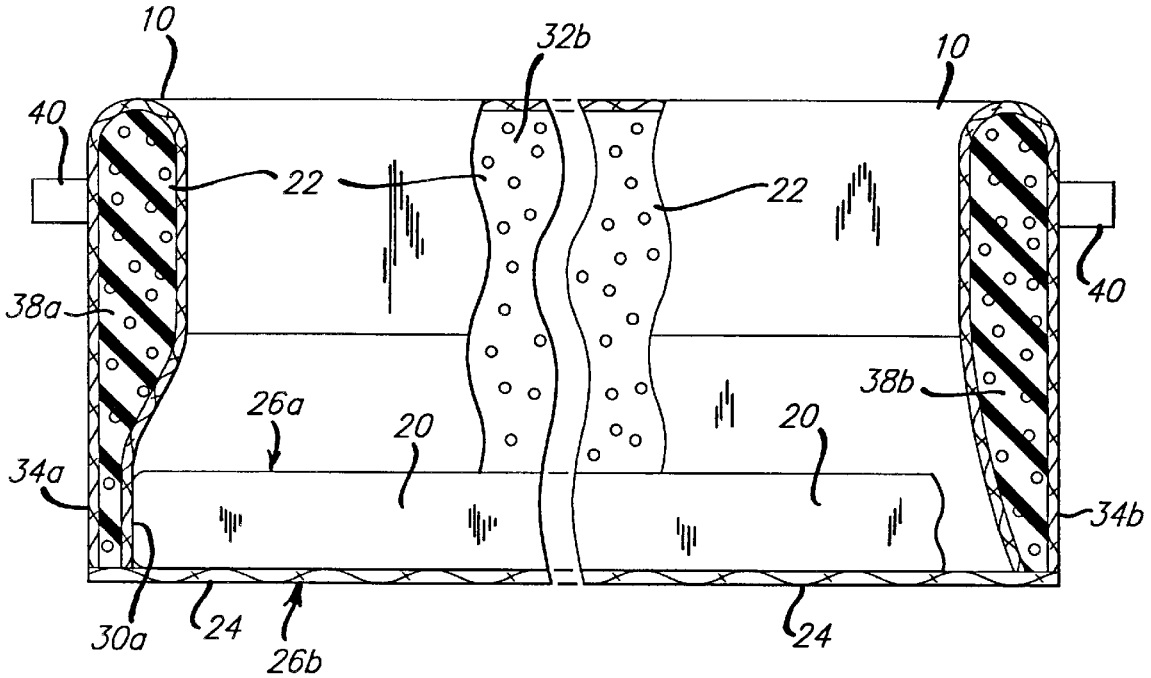
FIG. 3 is a cutaway side view of the rail guard of the present invention used independently of a crib.

Turning now to the drawing figures, reference is initially made to FIGS. 1–3, wherein a railing guard 10 is illustrated in combination with (FIGS. 1 and 2) and independent of (FIG. 3) a crib 12. The crib 12 includes a pair of upstanding spaced parallel sidewalls 14*a* and 14*b*, and a pair of upstanding spaced parallel endwalls 16*a* and 16*b* extending between the sidewalls 14*a*, 14*b* at the head and foot ends of the crib 12. The crib 12 also includes a generally rectangularly shaped horizontally arranged support structure 18 coextensive of the area defined between the side 14*a*, 14*b* and endwalls 16*a*, 16*b*. A mattress 20 is arranged directly above and is supported on the support structure 18 such that its side and end surfaces are arranged in close proximity to the upstanding side 14*a*, 14*b* and endwalls 16*a*, 16*b*. The mattress 20 includes upper and lower surfaces 26*a* and 26*b* and a pair of vertical side surfaces 28*a*, 28*b* arranged generally perpendicular to a pair of vertical end surfaces 30*a* and 30*b*.

A cushiony protecting wall 22 is attached to and projects upwardly from the outside perimeter of a base 24. The base 24 is sized and shaped to correspond to the size and shape of the mattress 20 such as a baby mattress or other form of padding. The cushiony wall 22 includes a pair of vertically oriented mattress receiving side sections 32*a*, 32*b* coextensive of an juxtaposed with the vertical side surfaces 28*a*, 28*b* of the mattress 20 directly above the base 24. The wall 22 also includes a pair of vertically oriented mattress receiving end sections 34*a*, 34*b* coextensive of and juxtaposed with the vertical end surfaces 30*a*, 30*b* of the mattress 20 directly above the base 24. As described in greater detail below, the side 32*a*, 32*b* and end sections 34*a*, 34*b* of the wall 22 are deformable to receive the mattress 20. A pair of vertically oriented side portions 36*a*, 36*b* extend upwardly from the mattress receiving side sections 32*a*, 32*b* so as to be coextensive of and juxtaposed with the inner side of the crib sidewalls 14*a*, 14*b*. A pair of vertically oriented end portions 38*a*, 38*b* extend upwardly from the mattress receiving end sections 34*a*, 34*b* coextensive of and juxtaposed with the inner side of the crib endwalls 16*a*, 16*b*.

A plurality of fasteners 40 are located at pre-selected positions on the outside perimeter of the wall 22 so as to maintain the vertical and horizontal orientation of the wall 22 in juxtaposed relationship with the side 14*a*,14*b* and endwalls 16*a*, 16*b* of the crib 12. In this way, the cushiony wall 22 remains in place between the railings 42 of the crib 12 and an infant reclining upon the upper surface of the mattress 22, thus protecting the infant from possible injury resulting from inadvertent contact with the railings 42. The cushiony wall 22 is self-standing, such that the mattress 20 can take the form of any type of pad and can be used in conjunction with or independently of the crib 12 or other vertical support means.

When used with the crib 12, the main functions of the invention are to prevent the infant's arms, legs or head (i.e., appendages) from passing between the rails 42 of the crib 12 where they can be struck or injured by passing people, to prevent injury from impact and rubbing contact of the infant with the rails 42, to prevent teeth or mouth contact of the infant with the rails 42, and to prevent injury or suffocation from entry of the infant between the crib rails 42 and the mattress 20. When used with other vertical support means, such as a bassinet or a baby bath basin, and/or another form of base padding, different embodiments of the crib railing guard 10 of the present invention have different functions corresponding to the different embodiments. However, certain functions of the crib railing guard are provided by each embodiment whether used with or without a crib 12 or crib railing 42.

In one embodiment of the present invention, the cushiony wall 22 has mattress receiving side 32*a*, 32*b* and end 34*a*, 34*b* sections that are attached to the base 24 and can be deformed as necessary to fit between the outside perimeter of the mattress 20 and the inside perimeter of the crib railing 42. Side 36*a*, 36*b*, and end 38*a*, 38*b* portions of the cushiony wall 22 may then stand erect next to the rails 42 while the base 24 rests on the mattress support structure 18 of the crib 12 or some other surface such as a bassinet, a baby bath basin, or the ground.

The self-supportive verticality or free-standing structure of the cushiony wall 22 can be provided with a design consistency of foam rubber or other type of resilient cushion 8. The mattress receiving side 32*a*, 32*b* and end sections 34*a*, 34*b* can be the same thickness as the side 36*a*, 36*b* portions 38*a*, 38*b* of the cushiony wall 22, but compressible to fit between the mattress 20 and the rails 42 and still have suitable self-supportive verticality as depicted in FIGS. 1 and 3.

In FIG. 2, the cushiony wall 22 is depicted inside a border of the railing 42 as shown in FIG. 1. The cushiony wall 22 has fasteners 40 selectively positioned around its perimeter which attach to the railing 42 for maintaining vertical and horizontal positioning. The base 24 is shown in a breakaway section of the mattress 20.

Figure 4:
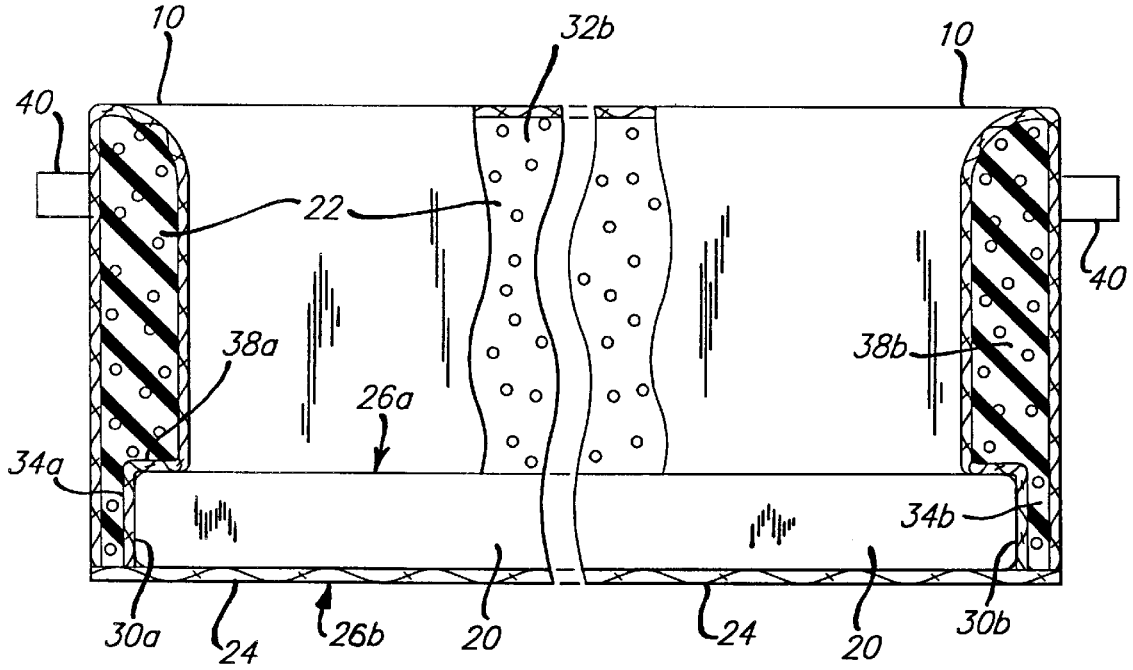
FIG. 4 is a cutaway side view of an alternate embodiment of the present invention which includes a cushion wall having a thick portion extending upwardly from the top surface of a mattress and used independently of a crib.

Referring to FIG. 4, an optional embodiment of the cushiony wall 22 includes side 36*a*, 36*b* and end portions 38*a*, 38*b* having an increased thickness extending vertically above the mattress 20 for increasing the self-supportive verticality and cushiony comfort of the guard railing.

Figure 5:
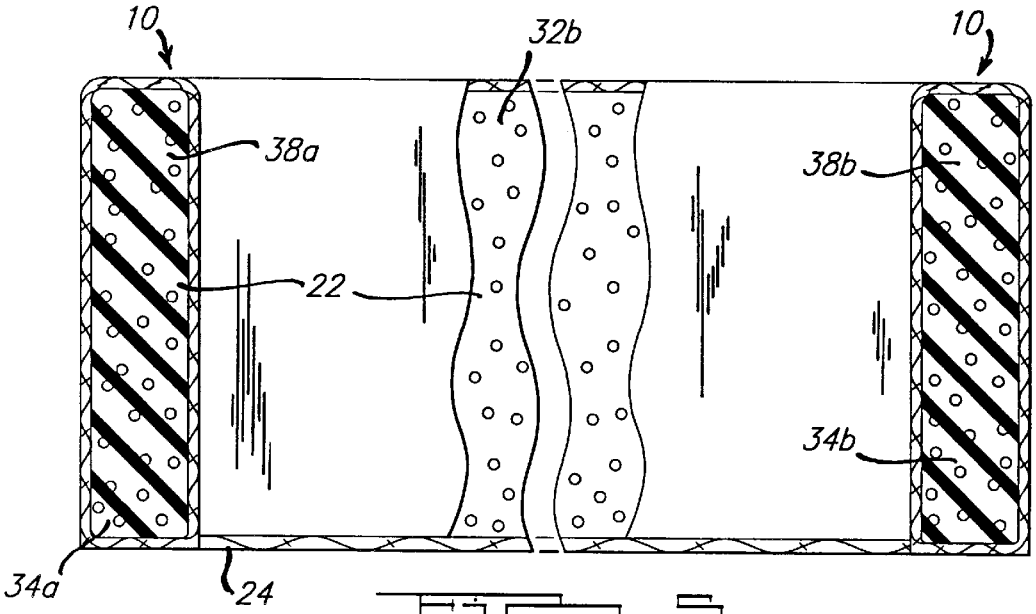
FIG. 5 is a cutaway side view of an alternative embodiment of the present invention including a uniformly thick cushion wall.

Referring to FIG. 5, another optional embodiment of the cushiony wall 22 has uniformly thick side 36*a*, 36*b* and end portions 38*a*, 38*b* extending above the base 24 at the outside perimeter of the cushiony wall 22 for self-supportive verticality combined with cushiony comfort independent of railing 42, or other wall means. The uniformly thick side 36*a*, 36*b* and end portions 38*a*, 38*b* can be either outside the perimeter of the base 24, as shown, or above it such that the side 36*a*, 36*b* and end 38*a* 38*b* portions can rest either on the base 24 or on a surface outside the perimeter of the base 24.

Figure 6:
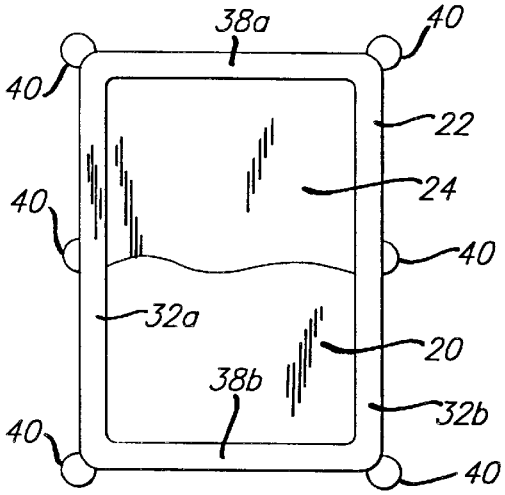
FIG. 6 is a top view of the embodiment of FIG. 3.
Figure 7:
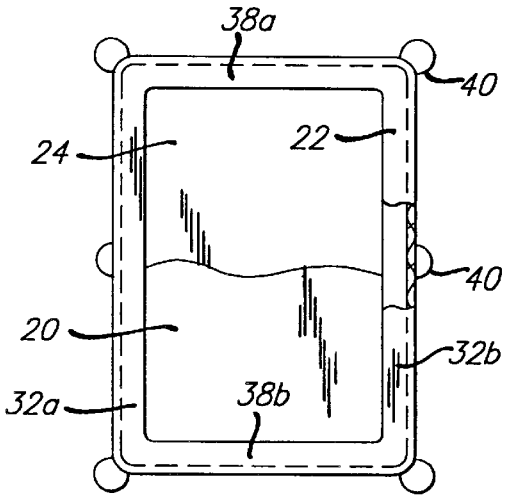
FIG. 7 is a partial cutaway top view of the embodiment of FIG. 4.
Figure 8:
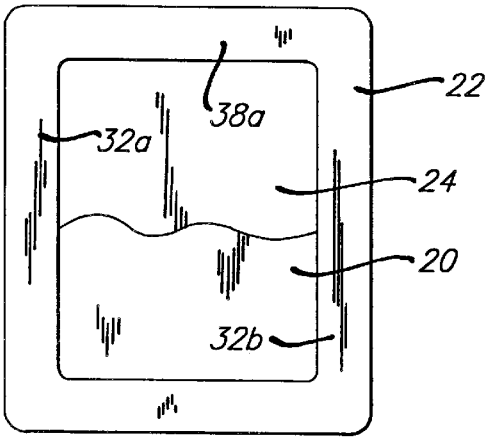
FIG. 8 is a top view of the embodiment of FIG. 5.

Referring to FIGS. 6–8, the cushiony wall 22 and the base 24 can be sized, shaped and used independently of a crib 12, or other infant support structure, regardless of whether the cushiony wall 22 is the type described in relation to either of FIGS. 3–5 or free-standing embodiments depicted in FIGS. 6–8, respectively.

Referring to the embodiments depicted in FIGS. 1–8, for aesthetic and comfort characteristics, the cushiony wall 22 can be covered with attractive cloth material with desired characteristics, regardless of its fabrication materials. The cushiony wall 22 and the base 24 are typically constructed from cloth fabric, but can be any other flexible material for particular design objectives. Additionally, the cushiony wall 22 and the base 24 can be constructed of moisture-resistant material for different design objectives. Furthermore, the cushiony wall 22 and the base 24 can be constructed to be disposable or of disposable material such as that available from Kimberly Clark.

Figure 9:
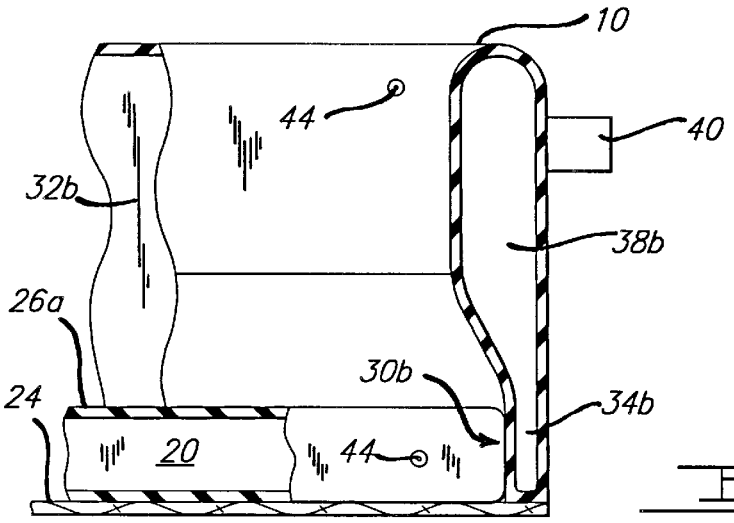
FIG. 9 is a sectional view of an inflatable embodiment of the railing guard shown in FIGS. 1, 3 and 6.
Figure 10:
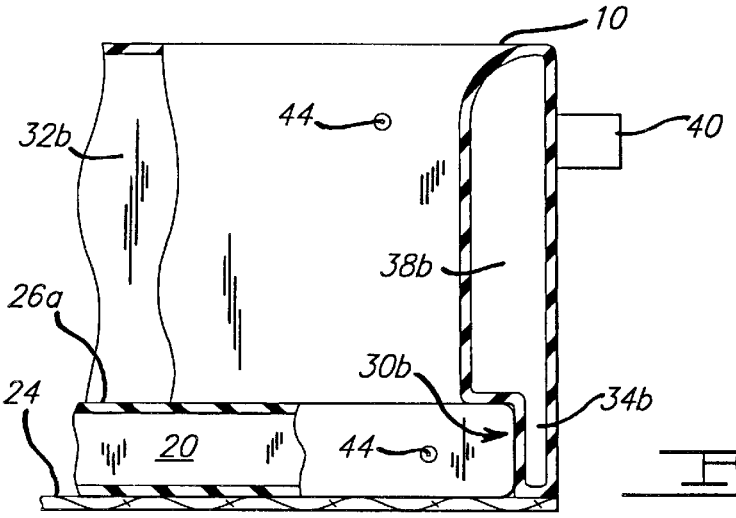
FIG. 10 is a sectional view of an inflatable embodiment of the railing guard shown in FIGS. 4 and 7.
Figure 11:
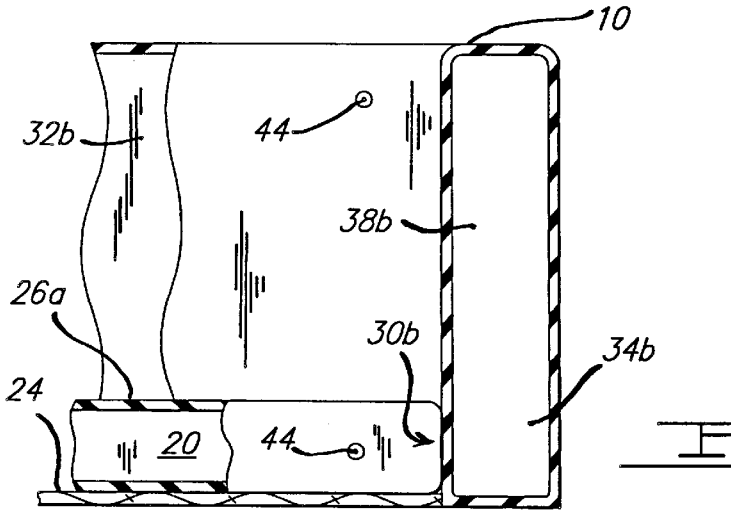
FIG. 11 is a sectional view of an inflatable embodiment of the railing guard shown in FIGS. 5 and 8.

Referring to FIGS. 9–11, either of the embodiments illustrated in FIGS. 3–8 can be made inflatable with hollow interiors and air-pressurization valves 44 for filling them with air or fluid. They can be made with appropriately rubberized and leakproof materials and covered or surfaced with aesthetically desirable means. To avoid obtrusive contact, the air-pressurization valves 44 are preferably a needle-entry type as used for athletic balls instead of a stem type as used for tires.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification, and following claims.

What is claimed is:

1. In combination with an infant bed comprising a pair of upstanding spaced parallel sidewalls, a pair of upstanding spaced parallel endwalls extending between said sidewalls at the head and foot ends of the bed, a generally rectangular shaped horizontally arranged support structure coextensive of an area defined between the side- and endwalls, and an infant mattress arranged directly above and supported on the support structure, the mattress having upper and lower surfaces and a pair of vertical side surfaces arranged in close proximity to the upstanding sidewalls and a pair of vertical end surfaces arranged in close proximity to the upstanding endwalls, the improvement comprising:

an infant crib railing guard comprising a base that is sized and shaped to correspond with a size and shape of the mattress and said base disposed across an upper side of the horizontal bed support structure such that said base is between said horizontal bed support structure and the lower surface of the mattress and said base spanning the entire length and width of the mattress and said base spanning the entire length and width of the mattress;

a cushiony infant protecting wall operatively connected to and projecting upwardly from a perimeter of said base, said wall comprising a first portion directly above said base and positioned between said mattress and said side walls and endwalls and said first portion deforming to receive and attach with the mattress, a second portion of said cushiony wall extending upwardly from said mattress receiving first portion such that said second portion extend a desired distance vertically above said mattress for restraining movement of an infant and appendages of the infant to a height above the mattress; and fasteners capable of attaching said cushiony wall to the side- and endwalls of the bed at selected positions around an outer perimeter of said cushiony wall to maintain vertical and, horizontal orientation of said cushiony wall in juxtaposed relationship with the side and end walls of the bed.

2. The infant crib railing guard of claim 1 wherein at least inner surfaces of said cushiony wall are constructed of moisture-resistant material.

3. The infant crib railing guard of claim 1 wherein said cushiony wall is inflatable.

4. The infant crib railing guard of claim 1 wherein said guard further comprises disposable paper fabric.

5. The infant crib railing guard of claim 1 wherein said vertically oriented side and end sections have a thickness suitable for extending the vertically oriented side and end sections above the upper surface of the mattress.

6. The infant crib railing guard of claim 5 wherein at least inner surfaces of said cushiony wall are constructed of moisture-resistant material.

7. The infant crib railing guard of claim 5 wherein said cushiony wall is inflatable.

8. The infant crib railing guard of claim 5 wherein said guard further comprises disposable paper fabric.

* * * * *

UNITED STATES PATENT AND TRADEMARK OFFICE

CERTIFICATE OF CORRECTION

PATENT NO. : 5,926,873

DATED : July 27, 1999

INVENTOR(S) : Irene Fountain

It is certified that error appears in the above-identified patent and that said Letters Patent is hereby corrected as shown below:

Title Page, [56] References Cited, add US Patent Documents:
--5,542,135 8/1996 Ozrovitz et al; 4,783,864 11/1988 Turner;
5,806,112 9/1998 Harms; 4,370,765 2/1983 Webber;
5,481,772 1/1996 Glynn et al--

Col. 3, line 1, delete "side" and substitute --sidewalls-- therefor

Col. 3, line 5, delete "side" and substitute --sidewalls-- therefor

Col. 3, line 16, delete "an" and substitute --and-- therefor

Col. 3, line 22, delete "side" and substitute --sidewalls-- therefor

Col. 3, line 34, delete "side" and substitute --sidewalls-- therefor

Col. 3, line 38, delete "mattress 22" and substitute --mattress 20-- therefor

Col. 4, line 7, after "36b" insert --and end--

Col. 4, line 31, delete "end 38a38b portions" and substitute
--end portions 38a, 38b-- therefor

UNITED STATES PATENT AND TRADEMARK OFFICE

CERTIFICATE OF CORRECTION

PATENT NO. : 5,926,873

DATED : July 27, 1999

INVENTOR(S) : Irene Fountain

It is certified that error appears in the above-identified patent and that said Letters Patent is hereby corrected as shown below:

Col. 5, lines 20-21, claim 1, delete "and said base spanning the entire length and width of the mattress"

Col. 6, line 7, claim 1, delete the comma after "and,"

Signed and Sealed this

Twenty-fifth Day of July, 2000

*Attest:*

*Attesting Officer*

Q. TODD DICKINSON

*Director of Patents and Trademarks*